US010472745B2

(12) United States Patent
Gielen

(10) Patent No.: US 10,472,745 B2
(45) Date of Patent: Nov. 12, 2019

(54) WEAVING MACHINE WITH AN APPARATUS AS WELL AS METHOD FOR HOLDING, FEEDING AND INSERTING WEFT THREADS IN A LOOM SHED

(71) Applicant: Lindauer DORNIER Gesellschaft mit beschraenkter Haftung, Lindau (DE)

(72) Inventor: Markus Gielen, Lindau (DE)

(73) Assignee: Lindauer DORNIER Gesellschaft mit beschraenkter Haftung, Lindau (DE)

( * ) Notice: Subject to any disclaimer, the term of this patent is extended or adjusted under 35 U.S.C. 154(b) by 86 days.

(21) Appl. No.: 15/754,374

(22) PCT Filed: Aug. 29, 2016

(86) PCT No.: PCT/EP2016/070280
§ 371 (c)(1),
(2) Date: Feb. 22, 2018

(87) PCT Pub. No.: WO2017/042039
PCT Pub. Date: Mar. 16, 2017

(65) Prior Publication Data

US 2018/0291538 A1 Oct. 11, 2018

(30) Foreign Application Priority Data

Sep. 10, 2015 (DE) ..... 10 2015 217 356

(51) Int. Cl.
*D03D 47/34* (2006.01)
*D03D 47/12* (2006.01)
(Continued)

(52) U.S. Cl.
CPC ..... *D03D 47/34* (2013.01); *D03D 47/125* (2013.01); *D03D 47/38* (2013.01); *D03D 49/70* (2013.01)

(58) Field of Classification Search
CPC .... D03D 47/125; D03D 47/34; D03D 47/308; D03D 47/48; D03D 49/70; D03D 47/00;
(Continued)

(56) References Cited

U.S. PATENT DOCUMENTS 3,587,665 A * 6/1971 Monge ..... D03D 47/00 139/453
4,540,028 A * 9/1985 Gehring ..... D03D 47/38 139/450
(Continued)

FOREIGN PATENT DOCUMENTS

BE 1 012 989 7/2001
DE 1 937 134 2/1970
(Continued)

OTHER PUBLICATIONS

International Search Report of the International Searching Authority for International Application PCT/EP2016/070280, dated Nov. 29, 2016, 2 pages, European Patent Office, HV Rijswijk, Netherlands.
(Continued)

*Primary Examiner* — Robert H Muromoto, Jr.
(74) *Attorney, Agent, or Firm* — W. F. Fase

(57) ABSTRACT

Apparatus and method for holding and feeding weft threads to the gripper of a weaving machine with drives, with which clamps for the weft threads are moved on motion paths into respectively a feed position, a transfer position and a ready position. The motion path of each clamp comprises a shape that is closed in itself. In that regard, the motion beginning of at least one of the clamps out of its ready position into its feed position takes place in a time segment that extends from the beginning of the beat-up motion of the weaving reed until the beat-up of the previously inserted weft thread against the beat-up line of the weaving machine.

10 Claims, 12 Drawing Sheets

(51) Int. Cl.
*D03D 47/38* (2006.01)
*D03D 49/70* (2006.01)
*D03D 47/00* (2006.01)

(58) Field of Classification Search
CPC ..... D03D 47/12; D03D 47/23; D03D 47/278; D03D 47/30; D03D 47/306; D03D 51/00; D03D 51/34; B65H 2701/31; B65H 63/088
See application file for complete search history.

(56) References Cited

U.S. PATENT DOCUMENTS 4,702,284 A * 10/1987 Gehring ..... D03D 47/34 139/446
4,756,343 A * 7/1988 Angebault ..... D03D 47/34 139/443
4,840,203 A * 6/1989 Moeneclaey ..... D03D 47/125 139/453
4,913,195 A * 4/1990 Speich ..... D03D 49/70 139/446
4,957,145 A * 9/1990 Verclyte ..... D03D 47/125 139/434
5,492,153 A * 2/1996 Stacher ..... D03D 47/125 139/450
5,570,726 A * 11/1996 Wahhoud ..... D03D 47/30 139/192
6,026,865 A * 2/2000 Krumm ..... D03D 47/125 139/453
6,102,082 A * 8/2000 Hehle ..... D03J 1/08 139/302
6,119,733 A * 9/2000 Arndt ..... D03D 47/38 139/194
6,758,246 B2 * 7/2004 Weixler ..... D03D 47/308 139/194
6,834,683 B2 * 12/2004 Birner ..... D03D 47/3073 139/370.2
6,938,648 B2 * 9/2005 Herrlein ..... D03D 47/12 139/116.1
7,650,913 B2 * 1/2010 Krumm ..... D03D 47/308 139/117
7,694,697 B2 * 4/2010 Lindenmueller .... D03D 47/125 139/116.1
7,753,084 B2 * 7/2010 Gielen ..... B65H 63/088 139/116.1
2008/0156390 A1 * 7/2008 Gielen ..... D03D 47/3013 139/435.4
2009/0090426 A1 * 4/2009 Lindenmueller .... D03D 47/125 139/449
2013/0199659 A1 * 8/2013 Gielen ..... D03D 47/23 139/448

FOREIGN PATENT DOCUMENTS

DE 35 24 727 1/1987
EP 0 240 075 10/1987
EP 0 644 286 3/1995
EP 0 902 109 3/1999
EP 1 367 159 12/2003

OTHER PUBLICATIONS

PCT International Preliminary Report on Patentability including English Translation of PCT Written Opinion of the International Searching Authority for International Application PCT/EP2016/070280, dated Mar. 13, 2018, 5 pages, International Bureau of WIPO, Geneva, Switzerland.
German Office Action in German Patent Application No. 10 2015 217 356.9, dated May 31, 2016, 3 pages, with partial English translation, 1 page.

* cited by examiner

B - B

WEAVING MACHINE WITH AN APPARATUS AS WELL AS METHOD FOR HOLDING, FEEDING AND INSERTING WEFT THREADS IN A LOOM SHED

TECHNICAL FIELD

The present invention relates to a weaving machine with an apparatus for holding, feeding and inserting weft threads in a loom shed of the weaving machine. Furthermore a corresponding method is presented.

PRIOR ART

In weaving machines, there are apparatuses and methods known in the prior art, in which various different weft threads are alternately inserted from an insertion side of the weaving machine by means of a gripper into the loom shed of the weaving machine formed by warp threads. In order to hold at readiness, weft threads that are not participating in the weft insertion in the respective weaving cycle, on the insertion side of the weaving machine, in the prior art auxiliary selvage threads—so-called catch selvages—or separate thread clamps for the weft threads are used. The use of separate thread clamps instead of catch selvages has the advantage that less thread waste is produced, because no auxiliary selvage threads are present on the insertion side of the woven fabric, which would then have to be removed before the further utilization of the woven fabric. It is further known to feed the above mentioned thread clamps with the respective weft thread clamped therein to the gripper before the weft insertion with the aid of drives, so that the fed thread end can be grasped by the gripper and then inserted into the loom shed. Through the use of such feeding or presenting thread clamps, a further reduction of the thread waste is achieved, because the thread ends of the weft threads, which remain standing or protruding outwardly beyond the fabric edge on both sides of the finished fabric, are shorter than in arrangements without feeding or presenting thread clamps.

Such a method is shown, for example, by EP 902109 A1. This apparatus works with piezo clamps, with the aid of which weft threads are alternately vertically positioned and fed to the gripper with a pivoting drive. Also the EP 1367159 A2, the EP 644286 A, the DE 1937134 and DE 3524727 A1 show apparatuses or methods for holding and feeding weft threads to the gripper of a weaving machine.

The EP 0240075 A2 finally describes a system of feeding clamps that are arranged next to one another on the insertion side of the weaving machine. Each one of these feeding clamps can be brought by means of its own drive respectively into three different positions A, B and C. These are respectively a readiness or ready position (A), a feeding or feed position (B) and a transferring or transfer position (C).

Modern weaving machines can be operated with weaving speeds of more than 600 weft insertions per minute. At these speeds, only very little time is available of the above described motions of the feeding clamps. In the EP 0240075 A2, a method is disclosed for the operation of the corresponding apparatus, in which for the motion of the feeding clamps from the ready position into the feed position only that time is available that is present between the beat-up of the last weft thread that was beat-up against the interlacing point of the weaving machine and the beginning of the motion of the gripper for the next subsequent weft insertion.

The weaving cycle of a weaving machine is typically divided into 360 angular degrees. This corresponds to one rotation of a main drive shaft of the weaving machine. If one assumes typical motion sequences of a gripper weaving machine and a speed of 600 weft insertions per minute, then the time between the beat-up of the last inserted weft thread against the interlacing point (=0 degrees machine angle) and the grasping of a new weft thread by the gripper (at approximately 60 to 70 degrees machine angle) amounts to only about 0.01 second. It has been found that this time is not sufficient to bring a massive thread clamp with the weft thread end clamped therein from a ready position into a feed position with the drives that are available today.

A further problem exists in that with an independent drive of the feeding clamps on the insertion side of the weaving machine, an impermissible crossing of two weft threads that follow one another in the weaving cycle cannot be excluded. Such a crossing can occur when a weft thread that is newly to be inserted, which is moved by means of its feeding clamp to the feed position, on its way crosses the path of the immediately previously inserted weft thread, which after the weft insertion is transported by the weaving reed in the direction toward the interlacing point of the woven fabric.

An object of the present invention is to provide a weaving machine with an apparatus and a method, with which more time is available for the motion of the feeding clamps out of the ready position into the feed position, and in which a crossing of weft threads on the insertion side is avoided.

DESCRIPTION OF THE INVENTION

This object is achieved by a weaving machine with an apparatus and a method according to the independent claims.

The weaving machine is equipped with an apparatus for holding and feeding weft threads to the gripper of the weaving machine. Furthermore with a first and a second clamp, as well as with a first and a second drive, which are respectively allocated to a clamp, so that the two clamps are movable independently of one another on motion paths respectively into a feed position, a transfer position and a ready position. These three positions are arranged on an insertion side of the weaving outside of a loom shed or beside the fabric edge of the weaving machine. In that regard, the respective feed position of the clamps is located in an area between the running path of the gripper and the outwardly extended beat-up line of the weaving reed. In this regard, the beat-up line is the forwardmost position of the weaving reed in the warp direction of the weaving machine upon beating-up the weft thread against the interlacing point of a woven fabric.

The feed position is now selected so that the respective weft thread in this position of the clamp extends between the weft thread supply or further guide means on the weaving machine and the associated clamp in such a manner so that it can be grasped by the gripper during the insertion motion of the gripper into the loom shed. Depending on the position of the beat-up line and also dependent on the embodiment of the gripper, in that regard the feed position can lie higher or lower in the weaving machine than the running path of the gripper or the beat-up line. The closer to the gripper that the respective feed position of a clamp lies, the shorter will be the weft thread ends that are taken along by the gripper during the insertion of this weft thread to the other side of the woven fabric.

The transfer position of the feeding clamps serves to allow the weft thread inserted into the loom shed by the gripper to be taken over again by the respective associated clamp after a transport of the weft thread carried out by means of the weaving reed in the direction toward the beat-up line of the weaving machine or the interlacing point of the woven fabric. Thereafter the clamp with the weft thread can again be brought into the ready position. The respective transfer positions of the clamps lie in the area of the outwardly extended beat-up line of the weaving machine. In that regard, they are arranged so close to the beat-up line or the fabric edge, so that the transfer of the weft thread moved by the weaving reed in the direction toward the beat-up line is supported or assisted by the respective clamp.

In the ready position, the clamped weft thread is held ready by the feeding clamp so long until it is again next in line or has the next turn to be inserted into the loom shed dependent on the requirements of the weaving pattern. Before the weft insertion, the feeding clamp with the weft thread clamped therein is brought into the feed position close to the gripper of the weaving machine.

The respective ready position of the clamps lies in the area above the respective transfer position and above the respective feed position. In that regard it is assumed that the weaving plane is arranged in the generally typical manner so that the loom shed is formed by an essentially vertical motion of the warp threads.

The weaving machine according to the invention is characterized in that the drives of the clamps are embodied and arranged on the weaving machine in such a manner so that

- the motion path of each clamp comprises a shape that is closed in itself;
- each clamp can be moved by means of the associated drive into three predefined positions that are arranged one after another along the respective motion path; these predefined positions are the feed position, the transfer position and the ready position;
- the respective clamp can be moved from the last one of these three positions—the ready position—into the first one of the three positions—the feed positions—without thereby coming into the intermediately located second position—the transfer position.

Through these features it is made possible to control the clamps in such a manner so that during the alternating insertion of the two weft threads, an impermissible crossing of the two weft threads on the insertion side is avoided. The described arrangement of the motion paths additionally achieves the preconditions so that at least one of the two clamps with the end of the next to be inserted weft thread clamped therein can begin the motion out of the respective ready position of this clamp in the direction toward its respective feed position very early in the weaving cycle. This results because, due to the closed shape of the motion path, a motion of the one clamp out of its ready position into its feed position is possible without this clamp thereby coming into its transfer position. Through similar or the same kind of construction of the drives and of the clamps, and through corresponding arrangement on the weaving machine, it can then be achieved that one clamp during the motion from its ready position into its feed position also does not come into the vicinity or proximity of the transfer position of the other clamp.

One possible structurally advantageous embodiment results when the drives are constructed or configured in such a manner so that the feed position, the transfer position and the ready position of the first clamp lie in a first motion plane, while the feed position, the transfer position and the ready position of the second clamp lie in a second motion plane different from the first motion plane.

In order to be able to utilize selectively more or fewer weft threads, it is suitable or sensible to construct the apparatus for holding and feeding the weft threads in a modular manner. One advantageous modular construction results in that the drive with the associated clamp is respectively arranged on its own housing or a carrier plate. Thereby it is achieved that similar or the same kind of modules of drive, housing and clamp can be arranged differently on the weaving machine depending on the number and requirements.

An advantageous arrangement also arises when the motion planes in which the motion paths of the clamps extend, with respect to a warp direction of the weaving machine, are bent or angled by an angle that lies in a horizontal plane of the weaving machine. This leads to the result that the respective feed positions of the clamps, as seen in the weft direction, lie further distant from the middle of the weaving machine than the receptive transfer positions. Thereby, the weft thread in the feed position is grasped already very early by the gripper on its way into the loom shed. The term weft direction defines a direction on the weaving machine parallel to the extension of the weft threads in the loom shed.

In a further embodiment, the modules of drive, housing and clamp are arranged on the weaving machine in such a manner so that the motion planes of the clamps are bent or angled relative to one another by an angle that lies in a vertical plane of the weaving machine extending in the weft direction. Through this fan-shaped arrangement of the modules it can be achieved that the feed positions of the clamps lie very close to one another or even at the same position in the weaving machine. This is advantageous for a small and also uniformly-long weft thread waste, both for the first as well as for the second weft thread. This is true to an even greater extent when more than two different weft threads and more than two clamps with the corresponding drives are used on the weaving machine. In principle, however, it is also possible to provide larger or smaller spacing distances between the various feed positions of the clamps. Through the described fan-shaped arrangement of the modules, the transfer positions of the clamps with respect to the weaving machine can also all be brought to the same geometric position. This is especially advantageous because thereby the same geometric relationships or conditions exist for each transfer of a previously inserted weft thread. Through the fan-shaped arrangement in the described manner, a spacing distance from one another as seen in the weft direction arises between the ready positions of the various different clamps.

In order to optimally utilize the available space for the apparatus on the weaving machine, it is furthermore suitable or sensible to arrange the housings with the drives for the clamps in a manner mirror symmetrically offset relative to one another.

In an advantageous embodiment of the weaving machine according to the invention, adjustment means are present, with which the motion beginning of the clamps with the ends of the next to be inserted weft thread clamped therein from the respective ready position into the feed position during the weaving cycle of the weaving machine is adjustable. This adjusting means can, for example, be a programmable control device for the drives of the clamps, of which the adjustment or programming is achieved via an input menu on the operator console of the weaving machine.

Furthermore, the weaving machine comprises means for cutting the inserted weft thread, which are known in principle to the skilled artisan. For that purpose, typically a weft thread cutter or weft thread scissors is arranged in the area between the insertion-side fabric edge and the transfer position of the clamps.

The available clamps and their drives are preferably constructed in a similar manner, so that they can be arranged modularly on the weaving machine. Such a module for holding and feeding a weft thread to the gripper of a weaving machine includes a housing or a carrier plate, as well as a clamp for the weft thread. Furthermore a drive is present, with which the clamp is movable into various different positions along a motion path. The module is characterized in that the drive includes a jointed transmission or linkage mechanism that is embodied in such a manner so that the motion path of the clamp comprises a shape that is closed in itself. This shape is, for example, circular or elliptical. Due to the closed shape of the motion path, it is possible to bring the clamp into three positions arranged one after another along the motion path, and to bring the clamp from the last one of these three positions into the first one of these three positions without thereby coming into the intermediately located second position. Relative to the prior art, this feature gives rise to an advantage because one clamp, along its motion path from the ready position into the feed position, can come along a section of the motion path that does not include the transfer position. With corresponding arrangement of several such modules on the weaving machine, therefore each one of the clamps moves on its way from the ready position to the feed position on a motion path that does not extend in the proximity of the transfer position of a different clamp. Thereby the danger of crossings between two alternately inserted weft threads becomes smaller. This leads to the result that the motion beginning of one clamp out of its ready position into the feed position can already occur before the previously inserted weft thread is beat-up against the beat-up line of the weaving machine.

One embodiment of the module according to the invention includes a drive with a motor and a jointed transmission or linkage mechanism with a crank that is drivable by the motor. Furthermore, a push rod or connecting rod is present, which is connected with the crank and is slidably supported in a slide joint. The slide joint is supported in a rotation point with respect to the housing of the module. Finally a clamp for the weft thread is provided, whereby the clamp is arranged most suitably at the point or tip of the push rod. In principle, also other types of drives or transmissions are possible, with which the described closed shape of the motion path of a moved clamp can be achieved. For example it is conceivable to move the housing and the push rod with linear motors that operate independently of one another. In the present example, the motion path of one clamp extends in a plane. However, transmissions or drives with which spatially curved motion paths are realized, are also technically possible.

The motor of the jointed transmission or linkage mechanism can, for example, be a stepper motor of which the motion beginning and motion speed is freely programmable or adjustable via corresponding control units. The motion of the clamp one after another into the predefined positions along the associated motion path is achieved in the present example embodiment with a constant or uniform rotational direction of the motor. If, however, the same weft thread is to be inserted two times after one another in two immediately successive weaving cycles, then the rotation direction of the motor can also be reversed, so that one clamp for example is moved from the transfer position directly again into the feed position.

Most suitably, the clamps are arranged at the point or tip of a push rod or connecting rod that is embodied needle-like, and that forms a part of the jointed transmission or linkage mechanism that has already been described above. The clamps can, for example, be embodied or configured as spring sheet-metal clamps, into which the respective weft thread is clamped in, with a closed spring-loaded clamp, or is pulled out. Especially advantageous, however, is the use of actively controllable clamps. For this, for example piezo clamps come into consideration, which are electrically controlled (for example like in EP 902109 A1), or pneumatically or electromagnetically controlled clamps or combinations of these operating principles.

In a further embodiment, the described module comprises a pneumatic cylinder with a pneumatic piston within the push rod. Moreover, a piston rod is provided, which is connected with the pneumatic piston. The clamp of the module is connected with the piston rod in such a manner so that the clamp can be opened or closed by operating the pneumatic cylinder.

Furthermore, a method for holding, feeding and inserting weft threads in a loom shed of a weaving machine is suggested. This method is especially suitable for the operation of the weaving machine according to the invention with its embodiments as described here.

For carrying out the method according to the invention, at least two weft threads and at least one gripper for the insertion of the weft threads into the loom shed formed by the warp threads are present. The insertion of the weft threads is achieved from an insertion side of the weaving machine. The weft threads are inserted preferably alternately in different successive weaving cycles. At least one first and one second clamp for holding and for feeding the weft threads to the gripper are available. Of course, the method can also be transferred to applications with more than two weft threads, which are then held and fed to the gripper by a correspondingly larger number of clamps. With the aid of a first and second drive, which are each respectively allocated to a clamp, the clamps are moved independently of one another on associated motion paths into respectively three different positions, namely into respectively a feed position, a transfer position and a ready position.

Furthermore, means for cutting the inserted weft thread, as known to the skilled artisan, are present on a weaving machine for carrying out the method. For that purpose typically a weft thread cutter or scissors is arranged in the area between the insertion-side fabric edge and the transfer position of the clamps.

A weaving cycle of the weaving machine is carried out, as is typical, over 360 degrees rotational angle of a drive shaft of the weaving machine. In the performance of the method according to the invention, successive weaving cycles include the following method steps:

- moving the first clamp with an end of first weft thread clamped therein out of a ready position of the first clamp into a feed position of the first clamp;
- grasping the first weft thread by the gripper;
- inserting the first weft thread into the loom shed;
- moving the first clamp into a transfer position of the first clamp;
- beating-up the first weft thread against a beat-up line of the weaving machine by means of a beat-up motion of a weaving reed;
- taking over the first weft thread by the first clamp;
- cutting the first weft thread so that a new first weft thread end arises;

moving the first clamp with the new end of a first weft thread clamped therein out of the transfer position of the first clamp into the ready position of the first clamp;

moving the second clamp with an end of a second weft thread clamped therein out of a ready position of the second clamp into a feed position of the second clamp;

grasping the second weft thread by the gripper;

inserting the second weft thread into the loom shed;

moving the second clamp into a transfer position of the second clamp;

beating-up the second weft thread against the beat-up line of the weaving machine by means of a beating-up motion of the weaving reed;

taking over the second weft thread by the second clamp;

cutting the second weft thread so that a new second weft thread end arises;

moving the second clamp with the new end of the second weft thread clamped therein out of the transfer position of the second clamp into the ready position of the second clamp.

According to the invention, for carrying out or performing the method, the drives of the clamps are embodied and arranged on the weaving machine in such a manner so that the motion path of each clamp comprises a shape that is closed in itself, and so that each clamp is moved by means of the associated drive into three positions arranged one after another along the respective motion path, namely the feed position, the transfer position and the ready position. In carrying out the method, furthermore each one of the clamps is moved on its motion path from the respective ready position into the feed positions without thereby coming into the intermediately located transfer position. According to the invention, the motion beginning of the motion of at least one of the two clamps out of its ready position into its feed position within the weaving cycle of the weaving machine lies in a time segment that extends from the beginning of the beat-up motion of the weaving reed until the beating-up of the previously inserted weft thread against the beat-up line of the weaving machine.

The described time sequence or progression is made possible by the respectively mutually independent drives of the clamps. These are actuated so that the clamp with the next to be inserted weft thread does not wait with its motion toward the gripper until the beating-up, transferring and cutting of the previously inserted weft thread has been achieved. Rather, the motion of the clamp with the next to be inserted weft thread begins already earlier in the weaving cycle than this was possible in the prior art.

Through this earlier motion beginning, a longer time segment in the weaving cycle is available for the motion of the clamp from the ready position to the feed position. Thereby, the maximum possible weaving speed (weft insertions per minute), at which a proper function of the clamps is still ensured, increases.

In the operation of the weaving machine according to the invention, the weft threads that are held ready typically extend beginning from the ready positions of the clamps in the direction toward the weft thread supply arranged outside of the weaving machine. The extension or path of the threads extends along straight lines that cross the insertion-side running path of the gripper above the gripper. In that regard, the weft thread that is held ready generally extends in the direction toward the weft thread supply through a series of thread guides or thread eyes, which are arranged behind the gripper offset next to one another similarly in the weft direction. The mentioned thread guides or thread eyes can be a part of an apparatus that is known in the prior art on weaving machines, of which the function generally consists in selecting the weft thread that is currently to be inserted dependent on the weave pattern, and moving this weft thread into the motion path of the gripper so that the gripper can grasp the weft thread and move it into the loom shed. This generally occurs through an essentially vertical motion of the mentioned thread eyes out of a position above and—as seen in the warp direction—behind the insertion-side motion path of the gripper, into a position located lower.

In the motion of the clamps for holding and feeding weft threads out of the respective ready position to the respective feed position, now various different extension paths of the weft threads in the direction toward the thread eyes or the weft thread supply arise beginning from the current position of the respective clamp. Depending on the motion sequence of the weft threads that are to be inserted alternately in successive weaving cycles, crossing points arise between the thread extension paths of various different weft threads, beginning from the current position of the respective clamp in the motion sequence in the direction toward the thread eyes or thread guides, in the m direction toward the weft thread supply of the weaving machine.

In carrying out the method according to the invention, in principle two different motion sequences A) and B) that are prescribed by the weave pattern can be distinguished from one another. In both cases A) and B), the so-called first clamp in the scope or context of the invention is that clamp that is arranged closer to the middle or center of the weaving machine or also closer to the insertion-side fabric edge, than the second clamp. The ready positions of the clamps are thus arranged offset from one another in the weft direction. This applies analogously or accordingly also in the use of more than two weft threads with more than two clamps.

Case A)

The weft thread to be inserted in the next weaving cycle is a so-called first weft thread in the scope or context of the invention. This refers to that weft thread that is brought out of the respective ready position into the respective feed position by a clamp that is here designated as the first clamp.

Case B)

The weft thread to be inserted in the next weaving cycle is a so-called second weft thread in the scope or context of the invention. This refers to a weft thread that is brought out of the respective ready position into the respective feed position by a clamp that is here designated as the second clamp.

The motions of the clamps must now be controlled both in the case A) as well as the case B) in such a manner so that the above described kinematically and geometrically necessitated thread crossings cannot lead to an interference in the weaving process. As mentioned above, a weaving cycle of the weaving machine takes place over a 360 degree rotational angle of a drive shaft of the weaving machine. The motion beginning of each clamp out of its ready position into the feed position in the weaving cycle of the weaving machine is now adjusted or programmed so that a crossing of the weft thread clamped by the respective clamp with the immediately previously inserted other weft thread during the transport of this inserted weft thread by the weaving reed to the beat-up line of the weaving machine is avoided.

For this purpose in the case A) it is suitable that the motion beginning of the first clamp out of its ready position into its feed position in the weaving cycle of the weaving machine is adjusted or programmed so that the first weft thread first crosses the motion path of the immediately previously inserted second weft thread after this second weft thread, during the transport by the weaving reed in the direction toward the interlacing point, has been moved under past the first weft thread clamped in the first clamp.

The geometric relationships on the weaving machine and the type of the motion of the weaving reed can be very different or varied. These parameters determine the motion beginning of the clamps. In a suitable embodiment of the method according to the invention, in the case A), the motion beginning of the first clamp out of its ready position into its feed position takes place in the weaving cycle in a range between 20 degrees before up to 0 degrees before the beating-up of the immediately previously inserted first weft thread against the interlacing point of the woven fabric or against the beat-up line of the weaving machine.

In the case B) it is advantageous to embody or configure the method so that the motion of the second clamp begins already earlier in the phase of the weaving cycle, while the previously inserted first weft thread is still being moved by the weaving reed in the direction toward the interlacing point. This occurs through such an adjustment or programming so that the second weft thread first crosses the motion path of the immediately previously inserted first weft thread after this first weft thread, during the transport by the weaving reed in the direction toward the interlacing point, has been moved over past the second weft thread clamped in the second clamp. In an advantageous embodiment of the method according to the invention in the case B), therefore the motion beginning of the second clamp out of its ready position into its feed position takes place in the weaving cycle in a range from 60 to 20 degrees before the beating-up of the last inserted first weft thread.

Due to the different spacing distances between ready position, feed position and transfer position, in the performance of the method according to the invention under certain circumstances, various different thread lengths arise in the course of the weft thread from the respective clamp via the thread eyes of the color selector up to the weft thread supply. Through a counter-directed activation of the thread eyes or through additional actively driven deflecting elements—for example several deflecting rollers—in the course or path of the weft thread, the described different thread lengths in the course or path of the weft thread can be compensated. A corresponding thread retriever or positioner is described, for example, in the DE 3524727 A1.

Depending on the type of the weft thread, it can also be suitable to support or assist the transfer or taking-over of the beat-up weft thread by the associated clamp in the transfer position by additional measures. That can be a motion of the clamp in the vertical direction, by which a e.g. hook-like embodied opened clamp can grasp the transversely presented weft thread. It can, however, also be thread guide elements that are arranged laterally on the weaving reed, and that press the laterally protruding thread end of the weft thread into the clamp that is standing ready during the beat-up motion. Such elements are disclosed, for example, in the EP 0240075 A1. For such a function, separate actively driven thread guides in the area of the beat-up line are also conceivable.

In the following, a possible embodiment of the weaving machine according to the invention is described.

ADVANTAGEOUS EMBODIMENTS OF THE INVENTION

Figure 1:
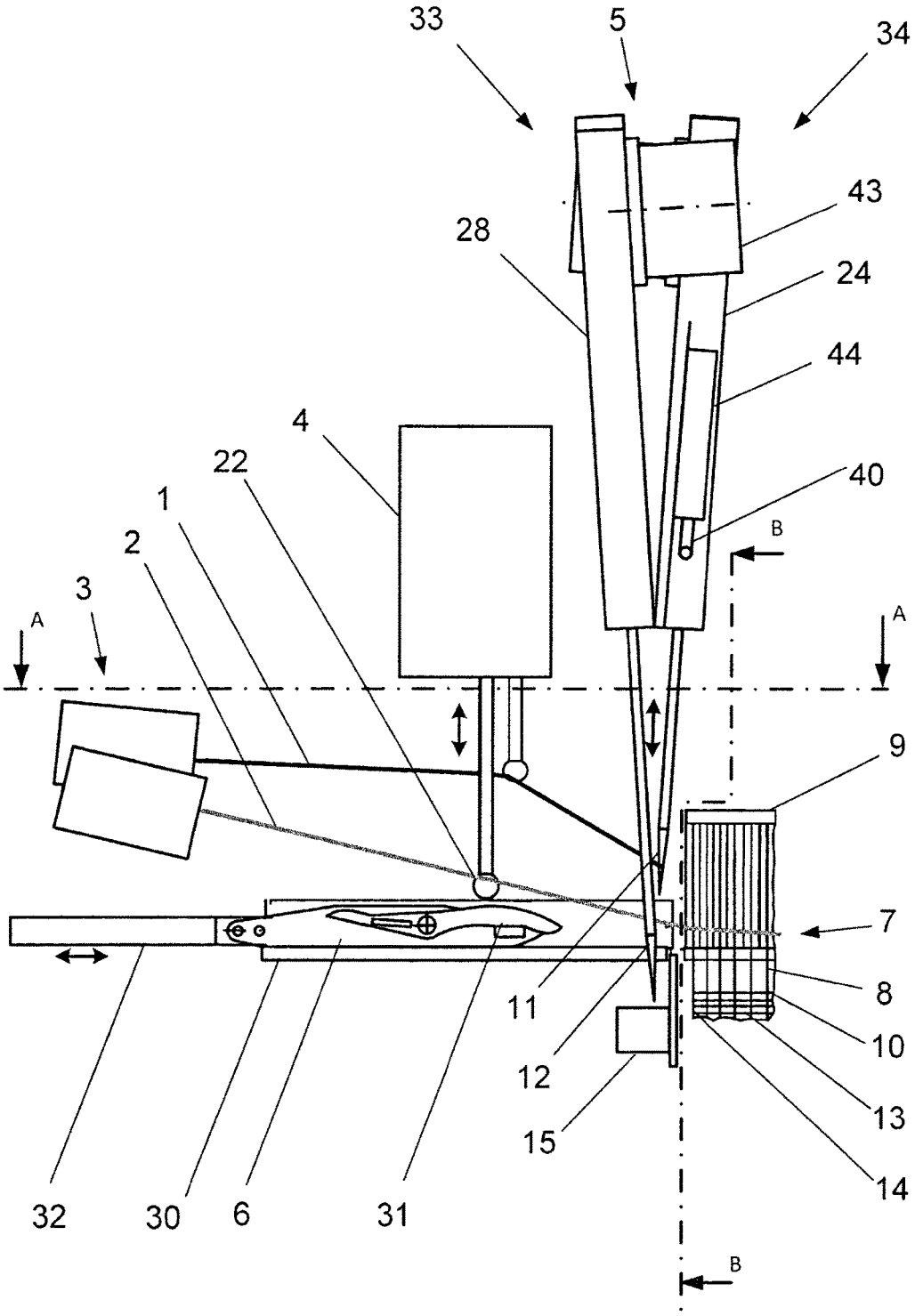
FIG. 1 Schematic partial view of the insertion side of a weaving machine with a view direction in the warp direction from the front.
Figure 2:
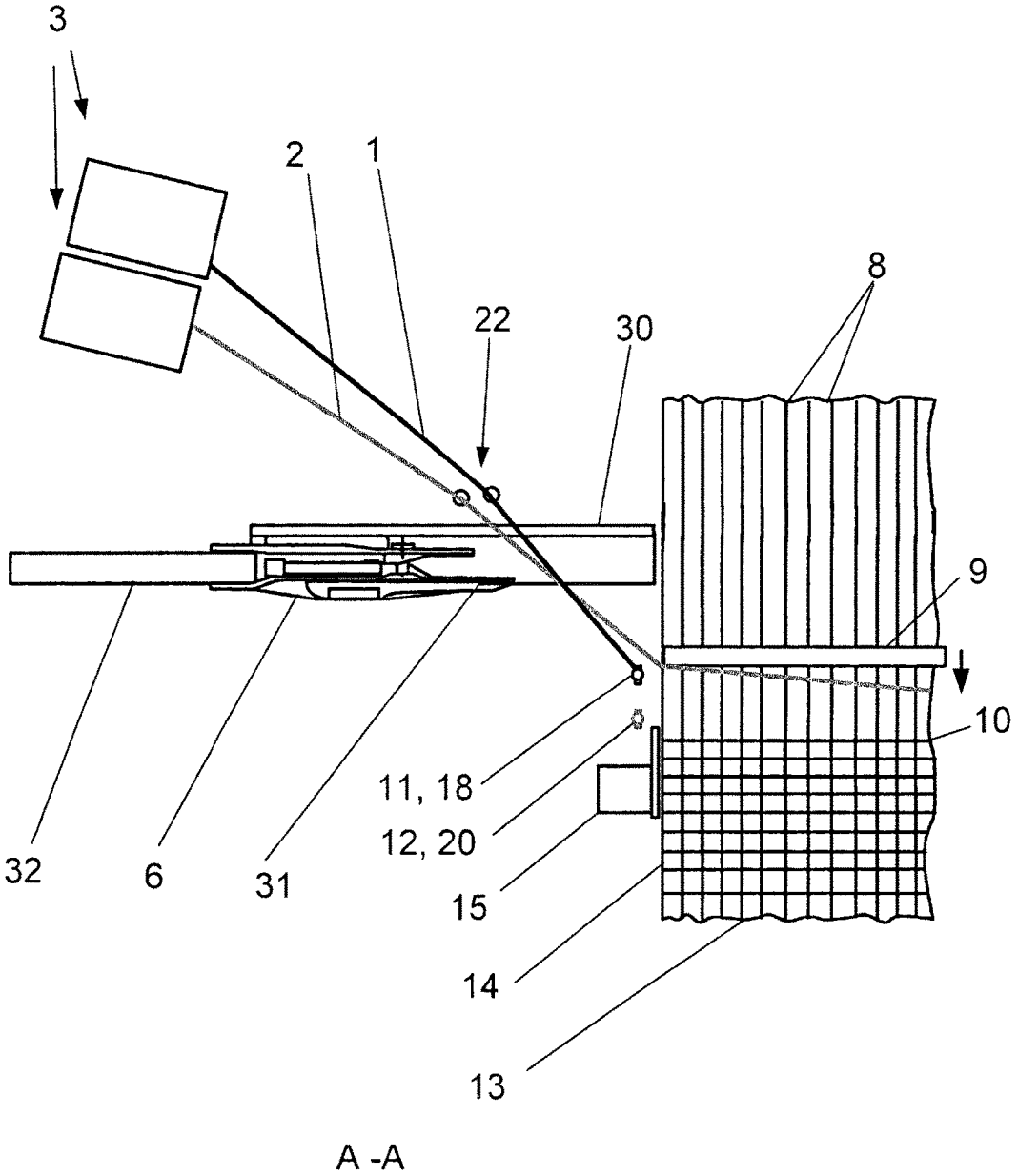
FIG. 2 View of the weaving machine according to FIG. 1, however with a view direction from the top, section A-A.
Figure 3:
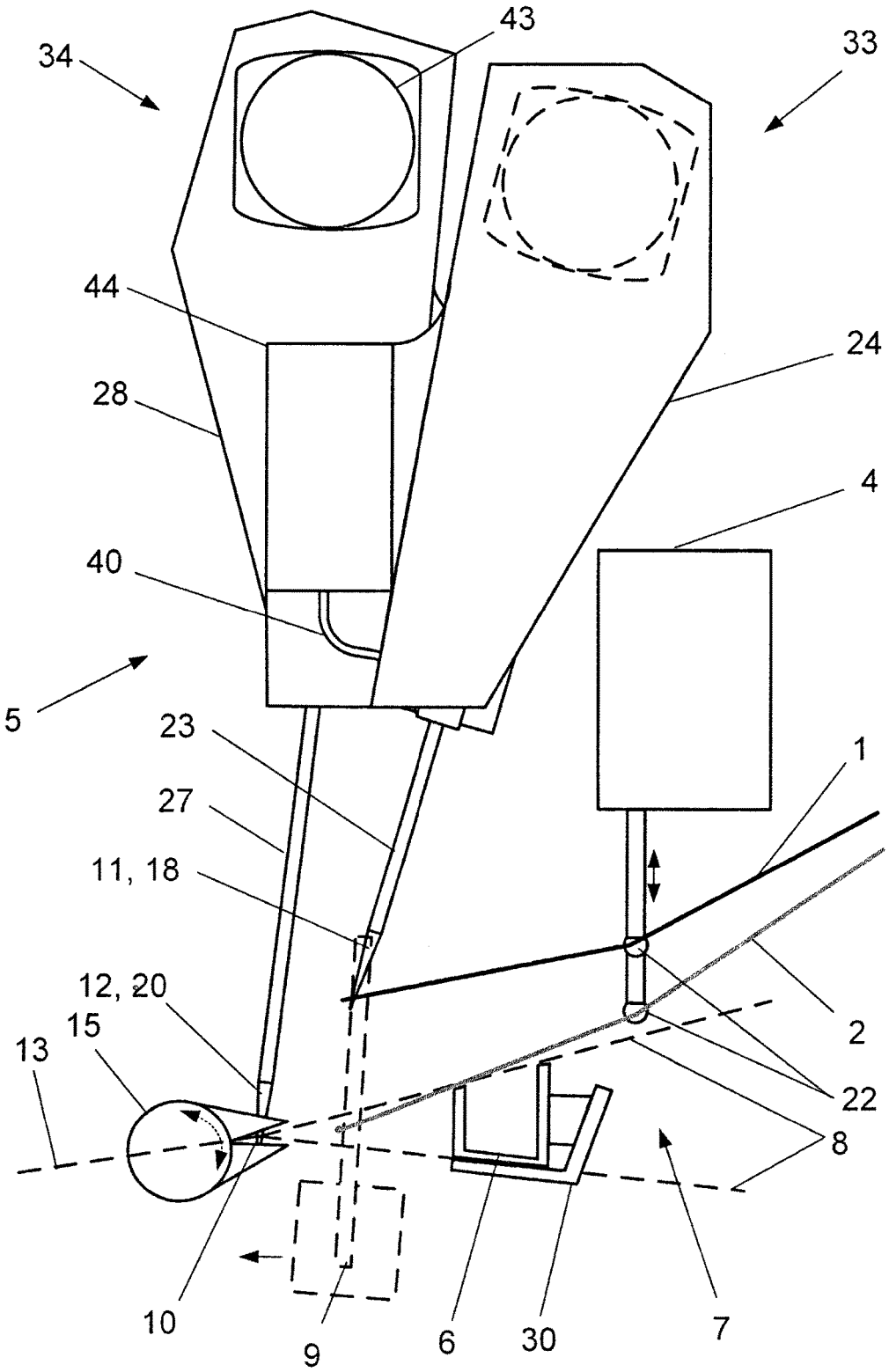
FIG. 3 View of a weaving machine according to FIG. 1, however with a view direction in the weft direction, section B-B.

The FIGS. 1-3 show schematic partial views of the insertion side of a weaving machine. Several weft threads—two weft threads 1, 2 in the present example—are drawn off from different supply bobbins 3. The weft threads 1, 2 are alternately brought into the motion line of a gripper 6, with the aid of an apparatus 4 for selecting weft threads—or weft colors—and an apparatus 5 for holding and feeding weft threads, and by this gripper are inserted into a loom shed 7. The loom shed 7 is formed in a known manner by warp threads 8. After the weft insertion, the inserted weft thread 2 is brought by a weaving reed 9 against the beat-up line 10 of the weaving machine or against the interlacing point of the woven fabric 13. Thereby, the weft thread 2 comes into the area of a clamp 12, which takes it up in a transfer position 20. Next the weft thread 2 is cut between the clamp 12 and the fabric edge 14 with the aid of a cutting device 15. Thereby two sections of the weft thread 2 arise. The one section remains in the woven fabric 13 and is transported together therewith in the direction toward a drawing-off apparatus—not shown. The clamp 12 with the other section or thread end of the weft thread 2 is brought into a ready position 21—not shown in the FIGS. 1 to 3—above the transfer position 20. As soon as the pertinent weft thread 2 is anew to be inserted into the loom shed 7, the thread end of this weft thread 2 is brought into a feed position 19 near the gripper 6 with the aid of the clamp 12. Simultaneously, the thread eye 22 of the apparatus 4 for selecting weft threads (for example a color selector) is moved downwardly. In this manner, the weft thread 2 comes into the path of the gripper 6 and can be grasped by it.

The FIGS. 1 to 3 show the situation in which the thread end of a first weft thread 1 is held by a first clamp 11 above the weaving plane in a first ready position 18. The first clamp 11 is arranged at the tip of a first push rod or connecting rod 23, which is supported in a first housing 24 and is connected within the first housing 24 with a first drive 25 that will still be explained in detail later. The first weft thread 1 extends along its path from the weft thread supply 3—e.g. from a yarn bobbin and possibly additionally through a pre-spooling device—via the eye 22 of a color selector 4 to the first clamp 11.

In the illustration according to the FIGS. 1 to 3, the second weft thread 2 is located in the loom shed 7 after it was immediately previously inserted by the gripper 6. It is illustrated how the weaving reed 9 moves the inserted second weft thread 2 in the direction toward the beat-up line 10 of the weaving machine. Outside of the loom shed 7 the second weft thread 2 extends beginning from the weft thread supply 3—similarly as for the first weft thread 1—via a lowered eye 22 of the color selector 4 to the loom shed 7. In the area of the extension of the beat-up line 10, a second clamp 12 is located in its transfer position 20. The second clamp 12 is arranged on the tip of a second push rod 27, which is supported in a second housing 28 and is connected with a second drive 29 within the second housing 28. The two housings 24, 28 with the drives 25, 29 for the clamps 11, 12 are in principle embodied similarly or of the same type, and in the present case are arranged mirror symmetrically and offset relative to one another.

Figure 12:
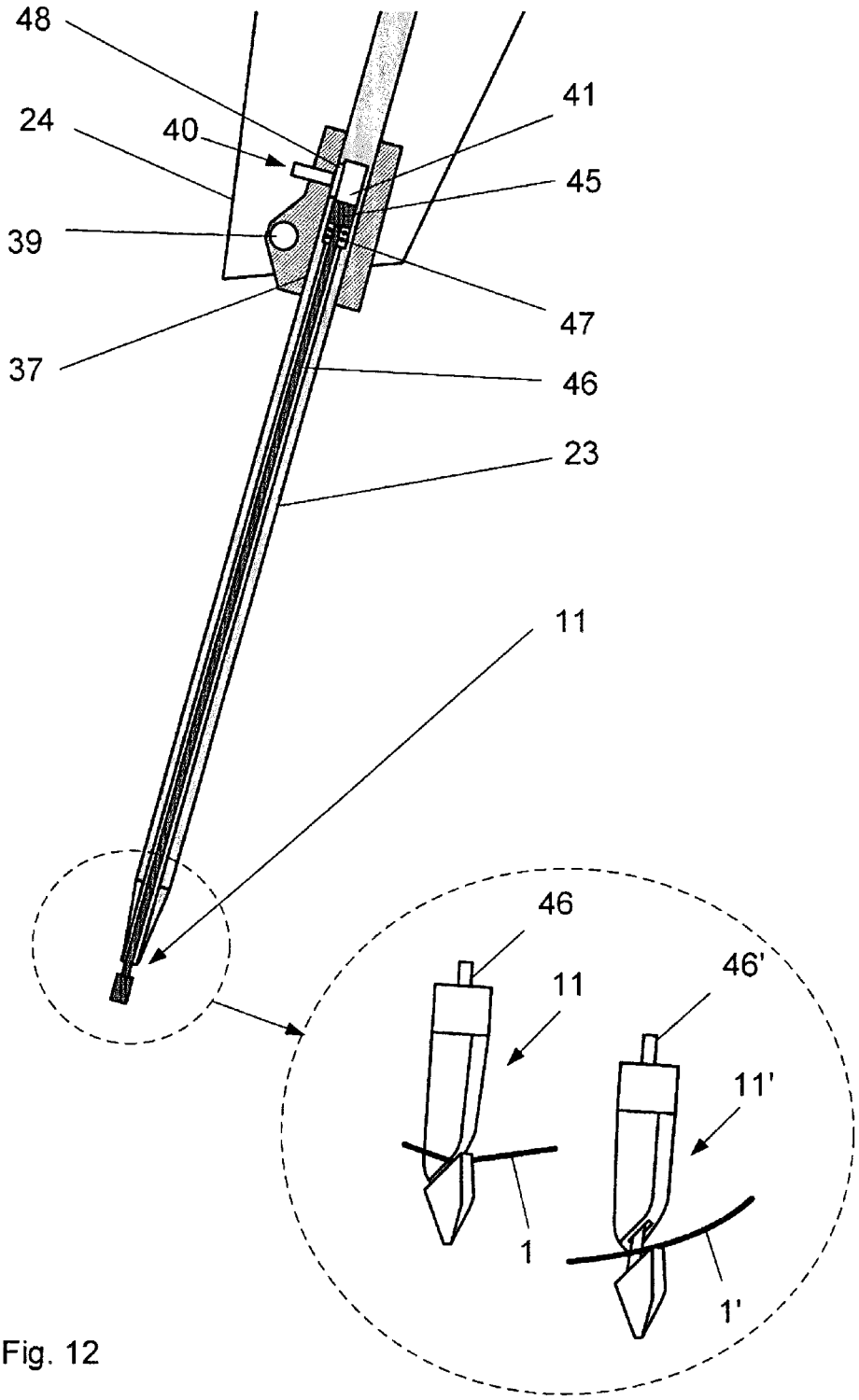
FIG. 12 Detail view of the push rod with pneumatic cylinder and clamp.

Starting from the position in the FIGS. 1 to 3, in the further progression of the process in the weaving cycle of the weaving machine, next the second weft thread 2 is transported against the beat-up line 10 of the weaving machine and is thereby beat-up against the interlacing point of the woven fabric 13. In that regard, the second weft thread 2 dips under and past the first weft thread 1 held in the first clamp 11. The crossing of the two weft threads 1, 2 illustrated in FIG. 2 is removed or avoided from this moment forward. Thereby, the path is cleared for a motion of the first weft thread 1 with the first clamp 11 that begins now, in the direction toward the feed position 16 of the first clamp 11 (see FIG. 4). The beat-up second weft thread 2 is introduced or guided into the second clamp 12 during the beating-up. In the present case, for this purpose the clamp 12 is pneumatically opened. How the control of the clamps 11, 12 is embodied will be described further below (FIG. 12).

It is also possible to support or assist the introduction of the weft thread 2 into the clamp 12 in the transfer position 20 by an upwards motion of the clamp 12. Thereby the weft thread 2 is grasped by the clamp 12. Also conceivable are additional thread guide elements that press the weft thread 2 actively into the clamp 12 in the transfer position 20. The same applies analogously for the sequence or progression of the transfer of the weft thread 1 by the clamp 11.

Figure 4:
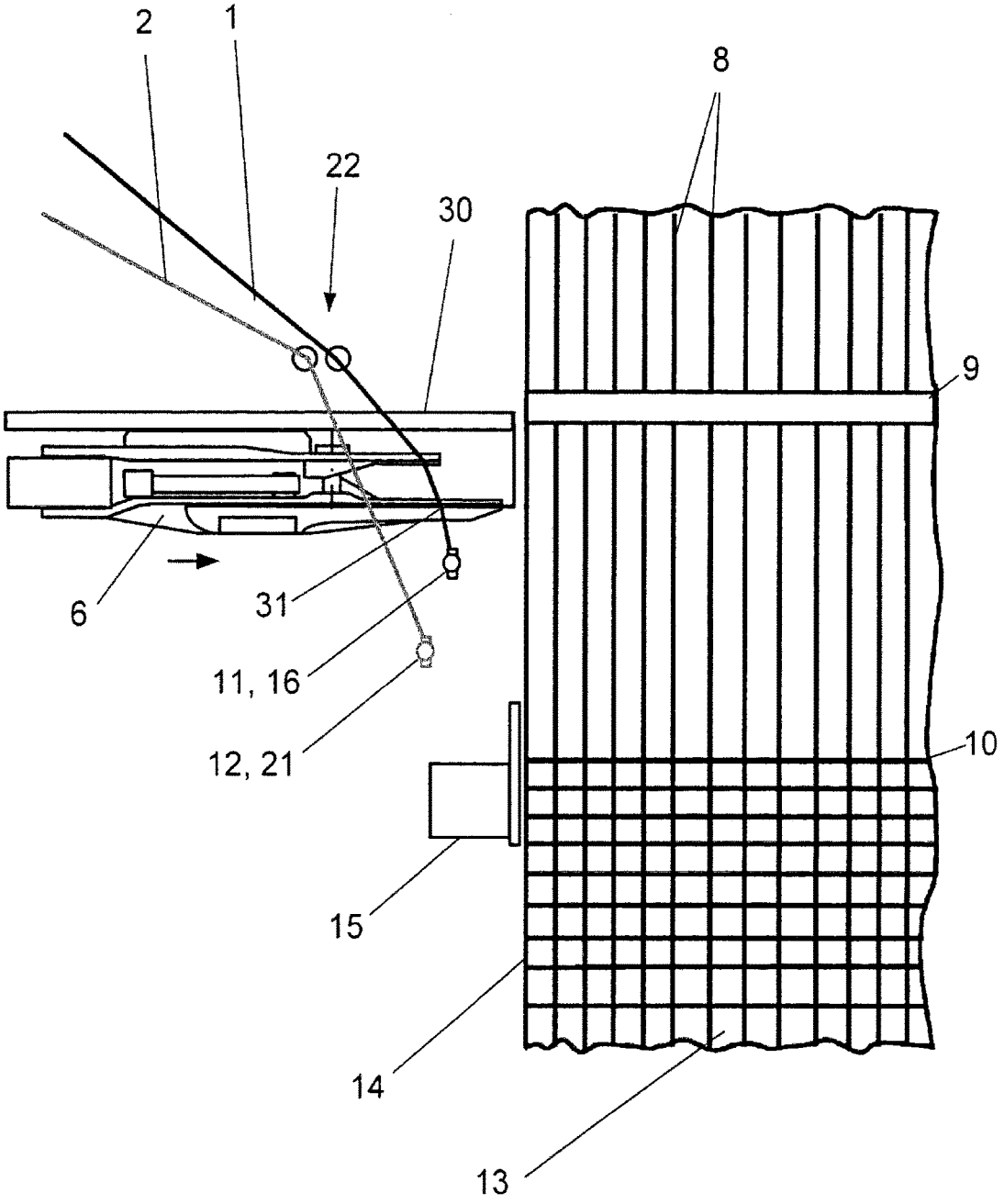
FIG. 4 Enlarged view of the weaving machine according to FIG. 2, however with different positions of the clamps and of the gripper.

After the second weft thread 2 has been grasped by the second clamp 12, this clamp is closed. Next, the second weft thread 2 is cut between the second clamp 12 and the insertion-side fabric edge 14 by a cutting device 15 embodied as a weft thread scissors. Thereupon, the second clamp 12 with the new end of the second weft thread 2 is brought into the ready position 21 of the second clamp 12 (see FIG. 4). The associated eye 22 of the color selector 4 is lifted in this process. Still during the taking-up of the second weft thread 2 by the second clamp 12, the first clamp 11 with the first weft thread 1 moves out of its ready position 18 into the feed position 16. Thereby the associated eye 22 of the color selector 4 moves simultaneously downwardly. The gripper 6 begins its motion in the direction toward the loom shed 7 and thereby grasps the first weft thread 1. At that moment when the gripper 6 grasps the first weft thread 1, the first clamp 11 is pneumatically opened. The control mechanism is constructed similarly or of the same type as for the second clamp 12 and will be explained in detail further below. Now the first weft thread 1 is inserted into the loom shed 7. This situation is illustrated in FIG. 4. The illustrated feed position 16 of the first clamp 11 lies close to the gripper 6. The ready position 21 of the second clamp 12, in contrast, lies approximately in the middle between the beat-up line 10 and the gripper 6—although above the feed position 19 and above the transfer position 20. The location of the various different pre-defined positions is described further below with the aid of the FIGS. 5 to 8.

The FIGS. 1 to 4 also show that the gripper 6 in the present example embodiment is guided outside of the loom shed 7 by a guide rail 30 mounted on the weaving machine. The gripper 6 is secured on a gripper rod or rapier 32 via which the gripper 6 is pushed forward into the loom shed 7 and pulled back. Depending on whether the gripper 6 is driven by a gripper rod 32 or a gripper band or tape, other forms of grippers and guide rails 30 may also be used. During its motion in the direction toward the loom shed 7, the gripper 6 grasps the transversely presented weft thread 1. For this purpose, the gripper 6 is equipped with clamp elements 31, which are actively actuated by non-illustrated control elements. Of course, as the clamp element 31 on the gripper 6, a simply spring-loaded gripper clamp is also possible, which does not need to be actively opened in order to be able to take up the tread. Such gripper clamps are known to the skilled artisan. Also known are elements that serve to move the gripper 6 forward into the loom shed 7 and back again in each weaving cycle. In the present example, the rigid gripper rod 32 is used for that purpose—however a flexible band or tape can also be utilized. The gripper rod 32 or a corresponding gripper band or tape are driven in a reversing manner by a transmission—such transmissions are known to the skilled artisan and are therefore not further illustrated.

For the invention it is also not significant whether the gripper 6 transports the weft thread 1, 2 over the entire width of the woven fabric 13 through the loom shed 7, or whether the weft thread 1, 2 is transferred in the middle of the weaving machine from a bringer-gripper to a taker-gripper, in order to be taken by it over the rest of the way through the loom shed 7.

Figure 5:
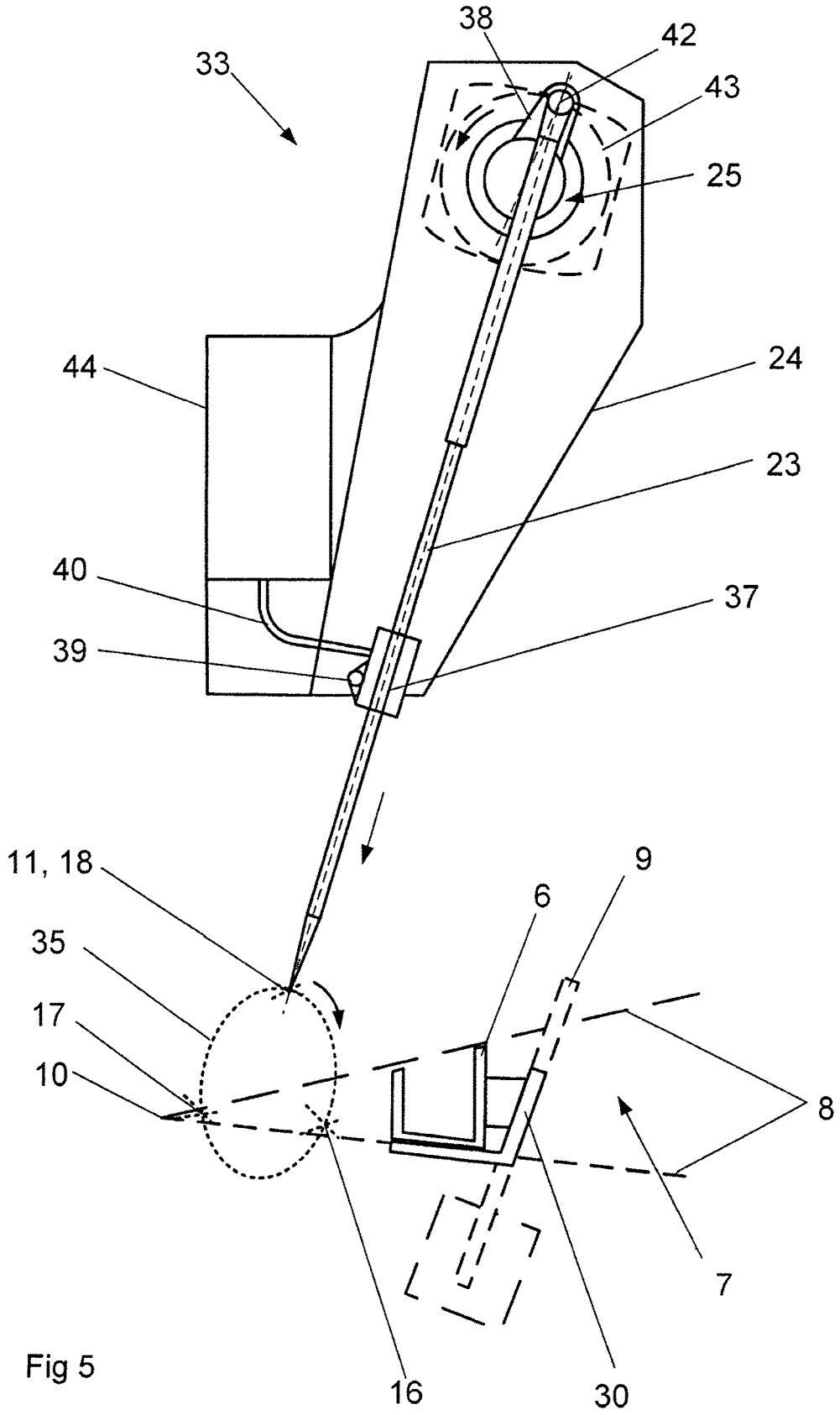
FIG. 5 Schematic view of a module for holding and feeding weft threads, illustration of the motion path with a view direction in the weft direction, clamp in ready position.
Figure 6:
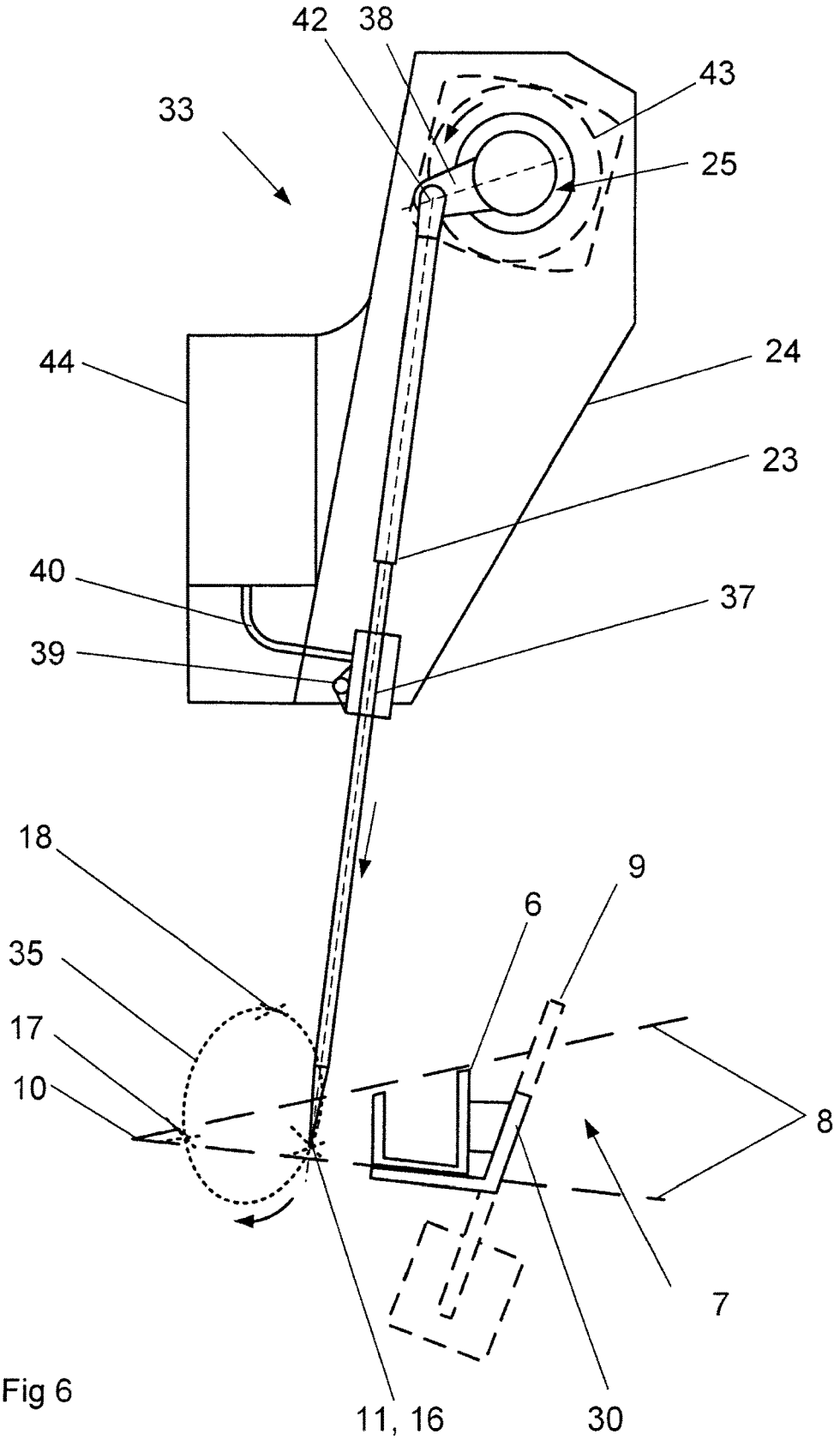
FIG. 6 Schematic view of the module according to FIG. 5, clamp in feed position.
Figure 7:
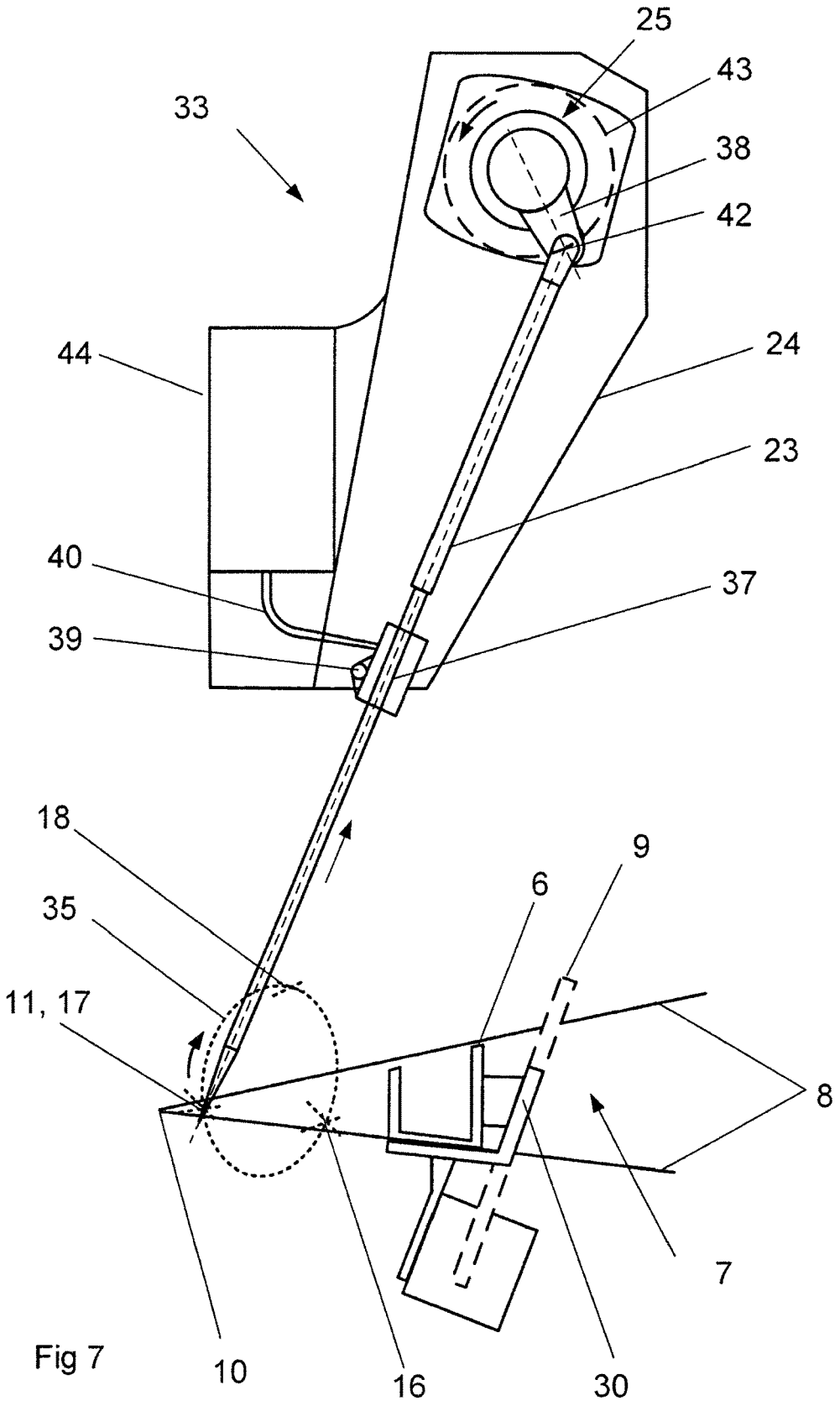
FIG. 7 Schematic view of the module according to FIG. 5, clamp in transfer position.

The FIGS. 5 to 7 show, in a schematic manner, details of a module 33 for holding and feeding a first weft thread 1 to the gripper 6 of a weaving machine. The FIGS. 5 to 7 are distinguished respectively from one another by the position of the clamp 11 that holds the weft thread 1 and brings it to the gripper 6.

The individual modules 33, 34 for holding and feeding respectively a weft thread 1, 2, as provided in the scope or context of the invention, are fundamentally constructed in a similar or same-type manner, although presently are arranged pair-wise mirror-symmetrically offset on the weaving machine.

A clamp 11 is located in the module 33 at the bottom end of a vertically slidable push rod 23. This push rod 23 is a part of a drive 25, which brings the clamp 11 on a motion path 35 into various different positions 16, 17, 18. The drive 25 is presently embodied in the manner of a slider crank mechanism or crank-and-rod drive. Several parts of the drive 25 are accommodated in a housing 24. The drive 25 includes a slide joint 37 that is rotatably supported in the housing 24, a crank 38 and a push rod or connecting rod 23 that is supported rotatably on the crank 38 and slidably on the slide joint 37. The push rod 23, which carries the clamp 11, is slidable in the slide joint 37. The slide joint 37 is rotatable about a rotation point 39 with respect to the housing 24. Compressed air 40 can be supplied via the slide joint 37, with the aid of which compressed air a small pneumatic cylinder 41 in the interior of the push rod 23 can be actuated (see FIG. 12). At its upper end, the push rod 23 is secured to the crank 38 of the slider crank mechanism in a rotation joint 42. The crank 38 is rotatingly driven by a motor 43.

The module 33 for holding and feeding the first weft thread 1 is connected with an electronic control unit 44 for the drive 25 of the clamp 11 and for the actuation of the pneumatics for opening the clamp 11. This electronic control unit 44 for the clamp 11 is connected with a non-illustrated controller of the weaving machine and with a compressed air source outside of the weaving machine. Data can be exchanged between the controller of the weaving machine and the controller of the clamp 11. These data include, for example, also informations about the momentary position of the various different moving parts in the weaving cycle as well as about the rotational speed of the weaving machine. Furthermore, devices for adjusting or programming the control unit 44 for the clamp 11 are present on the control unit 44 for the clamp 11 or on the controller of the weaving machine. Via these devices, there is also achieved a specification of the motion beginning or start of the clamp 11 out of one of its predefined positions 17 to 19 into a different predefined position 17 to 19. Furthermore, with these devices for adjusting the clamps 11, the time points for opening and closing the clamp in the weaving cycle can also be prescribed. Also the rotation direction of the drive 25 or the motion direction of the clamp 11 on its motion path 35 can be specified via the control unit 44 and the devices for adjusting or programming the clamp 11.

The motor 43, which drives the module 33 for holding and feeding weft threads, is mounted outside of the housing 24 and is connected via a non-illustrated shaft with the crank 38 in the interior of the housing 24. Details of the clamp 11 are illustrated in the FIG. 12, which will still be explained in detail further below. This description applies accordingly or analogously also for a module of the same kind with the second clamp 12.

In the FIGS. 5 to 7, it furthermore can be recognized, that during the rotation of the motor 43 in the direction of the arrow, the tip of the push rod 23 with the clamp 11 secured thereto runs through a closed motion path 35. The above defined positions of the clamp 11: the ready position 18, the feed position 16 and the transfer position 17, lie on this motion path 35. All three lie in one motion plane. Therefore in the present example embodiment, the motion path 35 resembles a planar ellipse with the longer axis in the vertical direction. In principle, of course also other drives 25 of the clamp 11 with other shapes of the motion path 35 are conceivable. Significant are the three predefined positions 16 to 18 of the clamp 11, or 19 to 21 of the clamp 12, and the relative location of these positions relative to one another and with respect to the remaining weaving machine, as described in the scope or context of the invention.

Figure 8:
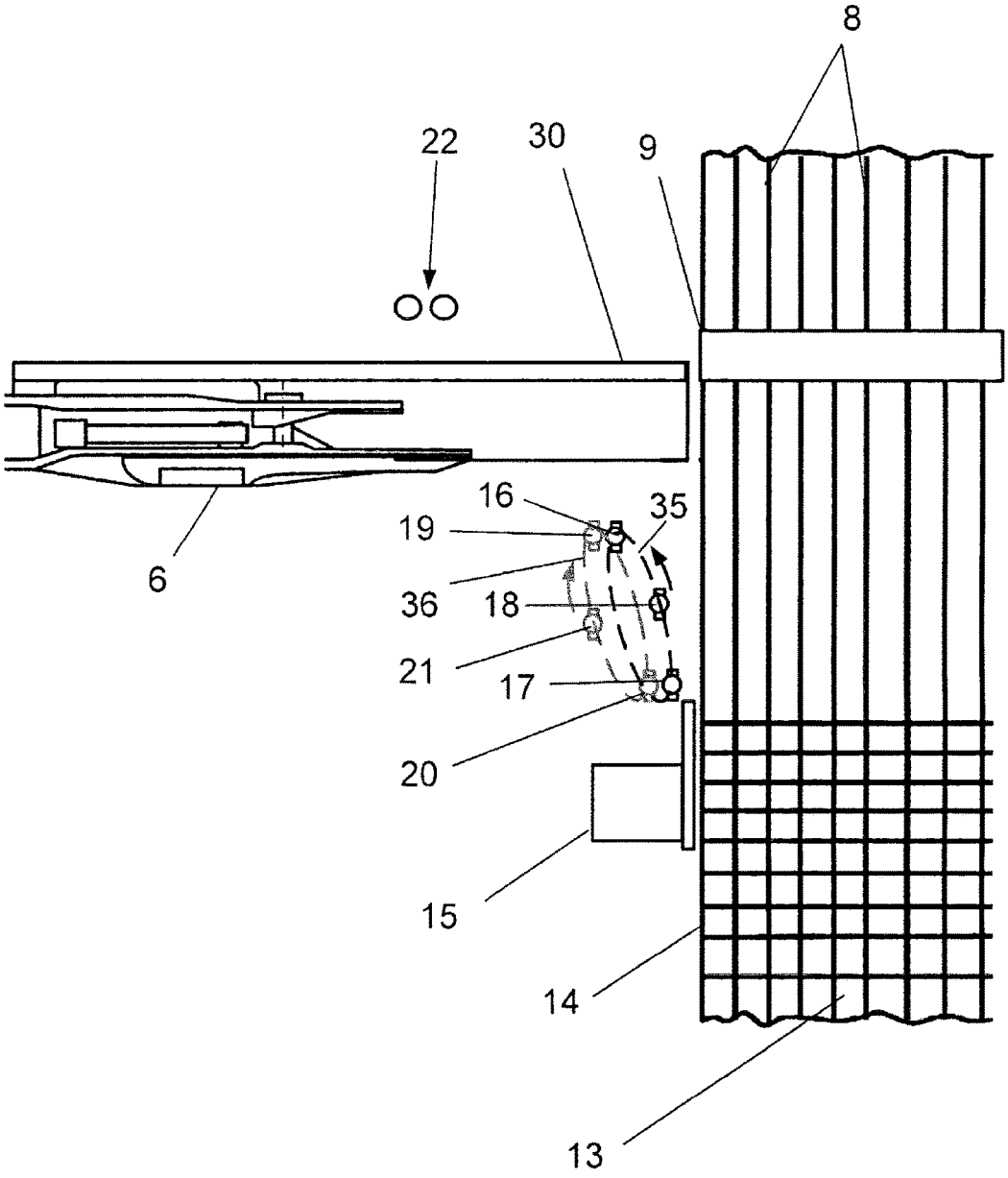
FIG. 8 Enlarged view according to FIG. 2 with illustration of the motion paths of the first and the second clamp.

FIG. 8 shows the arrangement of the present elliptical motion paths 35, 36 for an apparatus 5 with two modules 33, 34 for driving two clamps 11, 12. The view is similar to the FIG. 2—although enlarged. The weft threads 1, 2 were not illustrated in FIG. 8. In FIG. 8, the two clamps 11, 12 are respectively illustrated on the motion paths 35, 36 in the three predefined positions:

| | |
|---|---|
| 16 | feed position of the first clamp |
| 17 | transfer position of the first clamp |
| 18 | ready position of the first clamp |
| 19 | feed position of the second clamp |

-continued

| | |
|---|---|
| 20 | transfer position of the second clamp |
| 21 | ready position of the second clamp |

Figure 9:
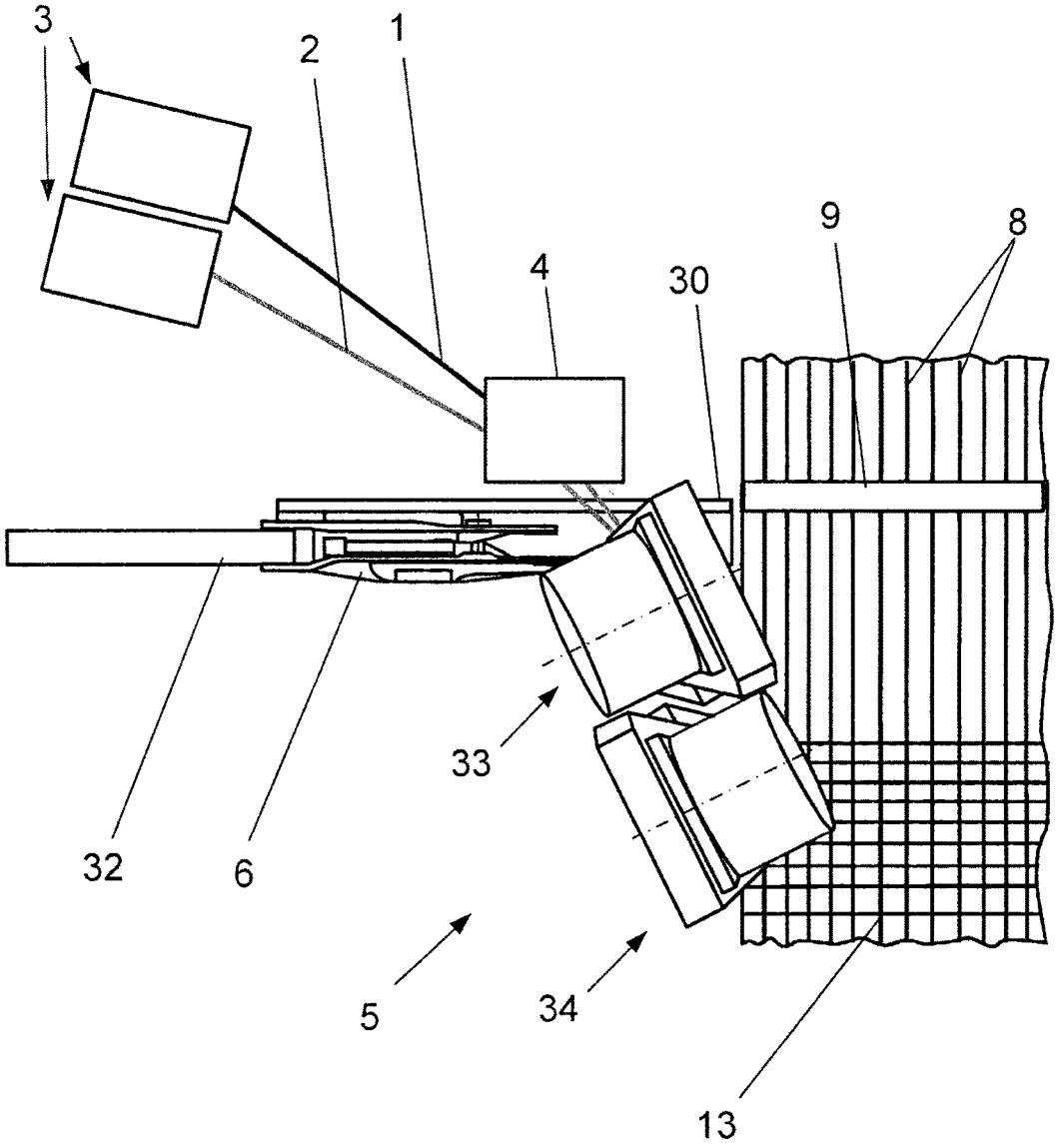
FIG. 9 View of the weaving machine according to FIG. 1, however with a view direction from the top onto the apparatus for holding and feeding weft threads.

In the embodiment described here, two modules 33, 34 for holding and feeding a weft thread are tilted or inclined relative to one another in a fan-shaped manner. The motion planes are bent or angled among one another by an angle that lies in a vertical plane of the weaving machine extending in the weft direction. As one can see in FIG. 8, thereby it is achieved that the longitudinal axes of the two elliptical motion paths 35, 36 of the two clamps 11, 12 tend to extend upwardly apart from one another. Thereby, the ready positions 18, 21 of the two clamps 11, 12 have a larger spacing distance from one another in the weft direction than the feed positions 16, 19 of the two clamps 11, 12. The feed positions 16, 19 in turn have a similar spacing distance from one another in the weft direction as the two transfer positions 17, 20. The FIGS. 8 and 9 further show that the modules 33, 34 for holding and feeding a weft thread are arranged so that the motion planes of the two clamps 11, 12 with respect to the warp direction of the weaving machine are bent or angled by an angle that lies in a horizontal plane of the weaving machine. This leads to the result that the feed positions 16 of the clamps 11, 12 have a larger spacing distance from the fabric edge 14 than the transfer positions 17, 20.

The FIGS. 1, 2, 3 and 4 show the situation for the case that the weft thread to be inserted in the next weaving cycle is a so-called first weft thread 1 in the scope or context of the invention (see above case A). That is to say, next the first weft thread 1 will be brought by the first clamp 11 out of the ready position 18 into the feed position 16. For distinguishing between the two possible sequences or progressions for holding and feeding the first or second weft thread, here the term "first clamp" or "second clamp" is defined in that the ready position 18 of the first clamp 11 is arranged closer to the insertion-side fabric edge 14 than the ready position 21 of the second clamp 12. The ready positions 18, 21 of the clamps 11, 12 are thus arranged offset relative to one another in the weft direction. The allocation of the weft threads 1, 2 to the thread eyes or thread guides 22 of the color selector 4 is achieved analogously to the allocation of the weft threads 1, 2 to the clamps. That is to say that the eye or thread guide 22 for the second weft thread 2 has a larger spacing distance from the fabric edge 14 than the eye 22 for the first weft thread.

The motions of the clamps 11, 12 are now controlled in the weaving cycle so that the thread crossings of the threads 1, 2, which are kinematically necessitated and which were described further above, cannot lead to an interference in the weaving process. For this purpose, presently in the sequence or progression according to case A), the motion beginning of the first clamp 11 out of its ready position 18 into its feed position 16 in the weaving cycle of the weaving machine is adjusted or programmed so that the motion beginning takes place approximately 10 degrees before the beat-up of the immediately previously inserted second weft thread 2 against the interlacing point. Thereby it is achieved that the first weft thread 1 first crosses the course or path of the immediately previously inserted second weft thread 2 after this second weft thread 2, during the transport by the weaving reed 9 in the direction toward the beat-up line 10, has been moved under and past the first weft thread 1 clamped in the first clamp 11 (see FIGS. 2 and 3).

In the present example, for the sequence or progression according to case A), however also other values can be adjusted or set for the motion beginning of the first clamp 11, if this is necessitated by the geometric relationships, the rotational speed of the weaving machine or the type of the gripper—and/or weaving reed motion. In principle it is of course also possible with the present arrangement, to adjustingly set a motion beginning of one clamp out of its ready position into the feed position, which only takes place after the beating-up of the immediately previously inserted weft thread. The advantages according to the invention are, however, then only partially achievable.

Figure 10:
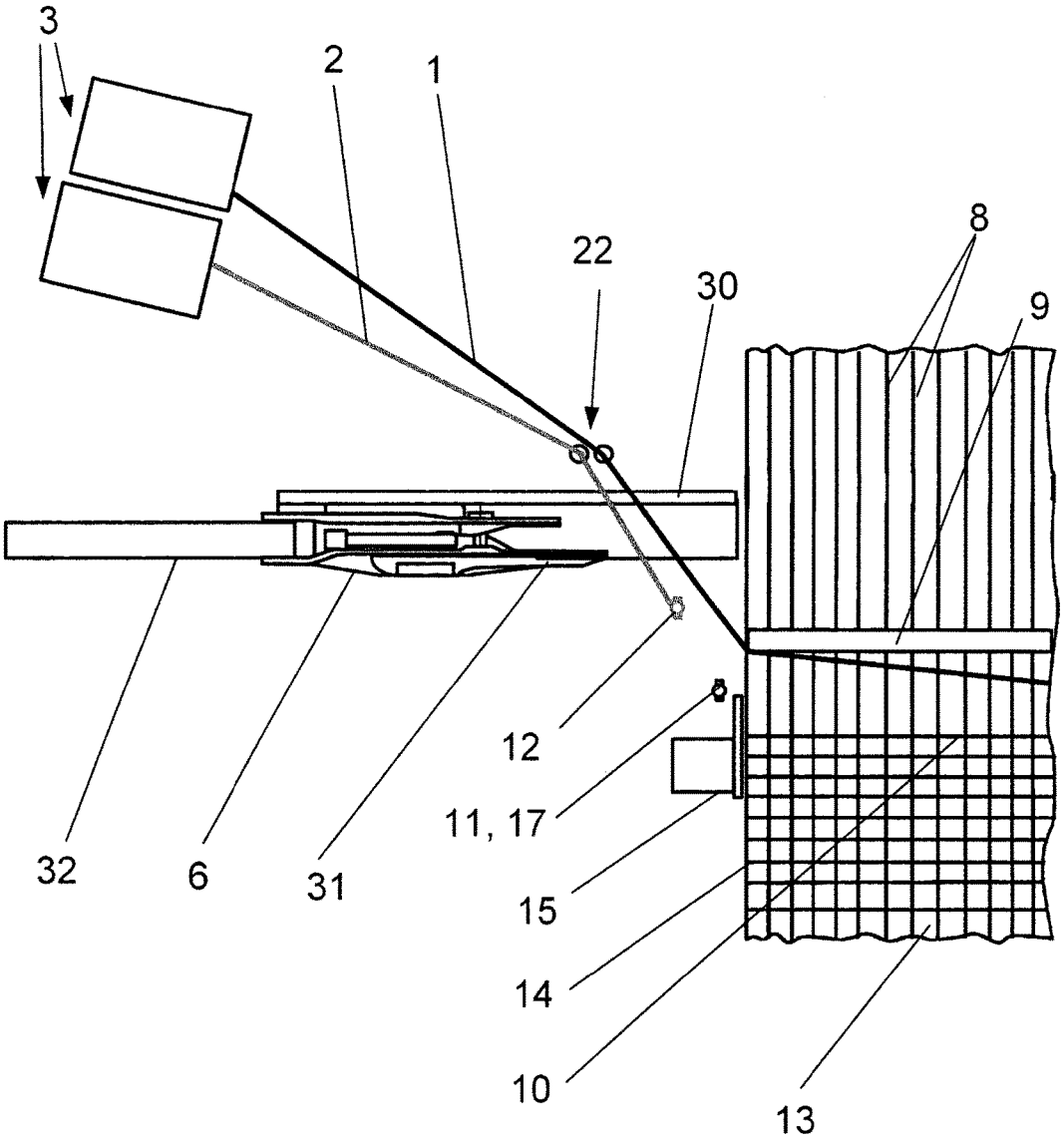
FIG. 10 View of the weaving machine according to FIG. 2, however first clamp in transfer position, second clamp on the way to the feed position.
Figure 11:
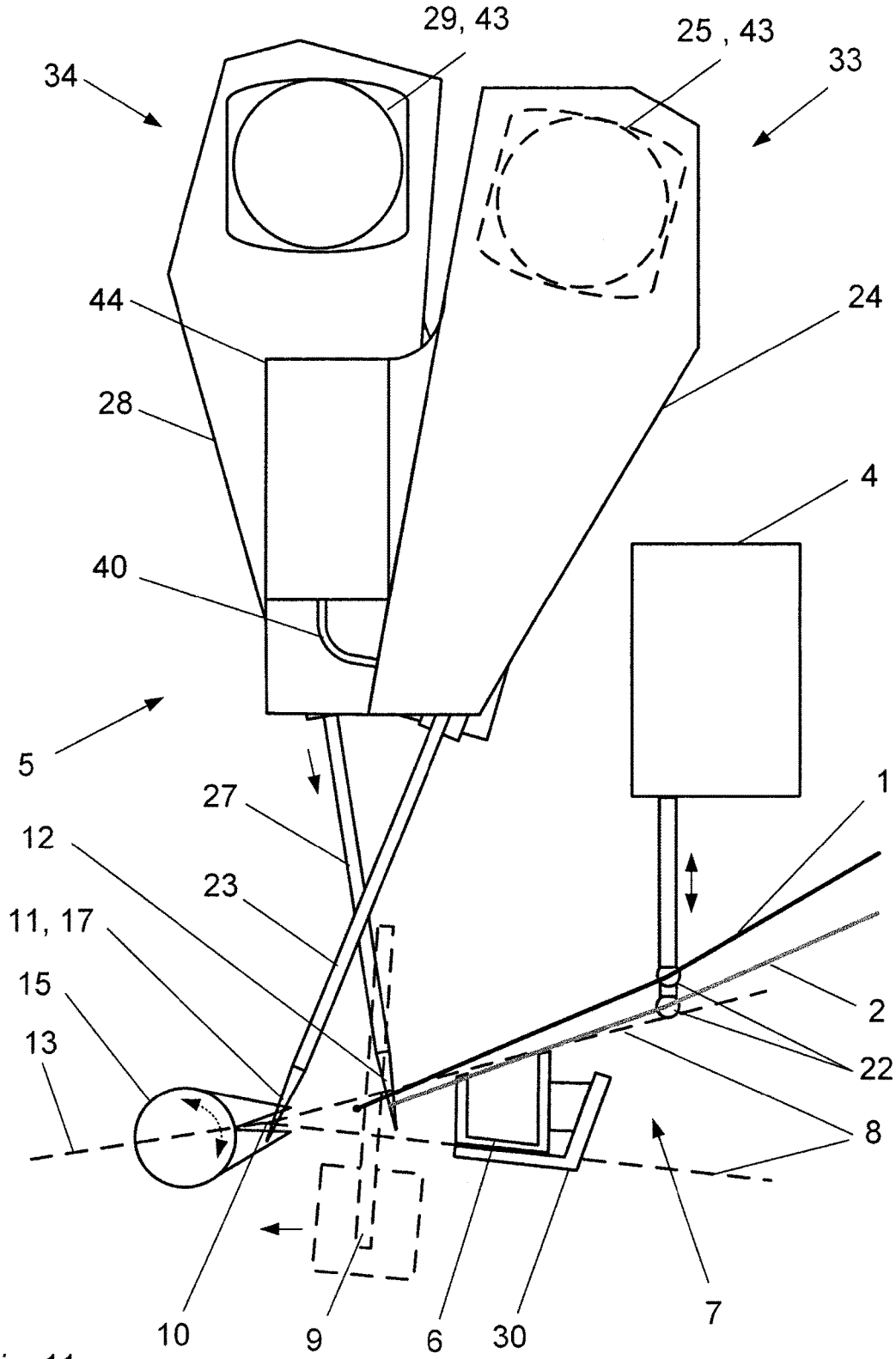
FIG. 11 View of the weaving machine according to FIG. 10, however with view direction in the weft direction according to section B-B in FIG. 1.

In FIGS. 10 and 11, the sequence or progression is illustrated, which was referred to above as case B). That is the case in which the weft thread to be inserted in the next weaving cycle is a so-called second weft thread 2 in the scope or context of the invention. That is to say, it involves the insertion of a weft thread 2 that is brought by a clamp that is here referred to as the second clamp 12 out of its ready position 21 into the feed position 19 and there is gripped by the gripper, while the previously inserted first weft thread 1 is transported or beat-up by the weaving reed 9 against the beat-up line 10. The sequence or progression of the method according to the FIGS. 10 and 11 (case B) is configured so that the motion of the second clamp 12 out of the ready position 21 into the feed position 19 begins already earlier in the phase of the weaving cycle while the previously inserted first weft thread 1 is still being moved by the weaving reed 9 in the direction toward the interlacing point. The sequence or progression is adjustingly set so that the second weft thread 2 first crosses the path of the immediately previously inserted first weft thread 1 after this first weft thread 1, during the transport by the weaving reed 9 in the direction toward the beat-up line 10, has been moved over and past the second weft thread 2 clamped in the second clamp 12 (see FIGS. 10 and 11). This occurs through such an adjustment or programming of the controller 44, that the motion beginning of the second clamp 12 out of its ready position 21 into its feed position 19 in the weaving cycle, for example takes place 40 degrees before the beat-up of the previously inserted first weft thread 1. If applicable, a support or assistance of these relative motions of the two weft threads relative to one another by a vertical motion of one or both eyes 22 of the color selector 4 with the weft threads 1 and 2 can be necessary. Also in the sequence or progression according to the FIGS. 10 and 11 (case B), other values can be adjustingly set for the motion beginning of the second clamp 12, if the geometric relationships, the rotational speed of the weaving machine or the type of the gripper- and/or weaving reed motion necessitate this.

In enlarged views, the FIG. 12 shows details of the first clamp 11, as well as of the push rod 23 with slide joint 37 and pneumatic cylinder 41. This illustration pertains analogously or accordingly also for the second clamp 12. The push rod 23 is supported slidably in the longitudinal direction in the slide joint 37. The slide joint 37 has a rotation point 39 via which it is rotatably supported in the housing 24. In the interior thereof, the push rod 23 contains a pneumatic cylinder 41 which is acted on by compressed air 40 on the upper side thereof. By the compressed air 40, the piston 45 together with the piston rod and the clamp 11 secured thereon is pressed downwardly. Thereby the clamp 11 on the tip of the push rod 23 is opened (clamp 11'). Upon switching off the compressed air 40 via a non-illustrated pneumatic valve, the piston 45 together with the piston rod 46 is pressed upwardly—the clamp 11 is closed—by the force of a spring 47. The compressed air 40 is directed into the pneumatic cylinder 41 via an opening 48 in the push rod 23. The opening 48 has the shape of an elongated hole, which is positioned so that the clamp 11 in the feed position 16 and in the transfer position 17 can be pneumatically opened and closed.

| Reference numbers | |
|---|---|
| 1 | first weft thread |
| 2 | second weft thread |
| 3 | weft thread supply |
| 4 | apparatus for selecting weft threads |
| 5 | apparatus for holding and feeding weft threads |
| 6 | gripper |
| 7 | loom shed |
| 8 | warp threads |
| 9 | weaving reed |
| 10 | beat-up line or interlacing point |
| 11, 11' | first clamp or clip |
| 12 | second clamp or clip |
| 13 | woven fabric |
| 14 | fabric edge |
| 15 | cutting device |
| 16 | feed position of the first clamp |
| 17 | transfer position of the first clamp |
| 18 | ready position of the first clamp |
| 19 | feed position of the second clamp |
| 20 | transfer position of the second clamp |
| 21 | ready position of the second clamp |
| 22 | thread eyes of the apparatus for selecting weft threads |
| 23 | first push rod or connecting rod |
| 24 | first housing |
| 25 | first drive |
| 27 | second push rod or connecting rod |
| 28 | second housing |
| 29 | second drive |
| 30 | guide rail for the gripper |
| 31 | clamp element of the gripper |
| 32 | gripper rod or rapier |
| 33 | module for holding and feeding a first weft thread |
| 34 | module for holding and feeding a second weft thread |
| 35 | motion path of the first clamp |
| 36 | motion path of the second clamp |
| 37 | slide joint |
| 38 | crank |
| 39 | rotation point of the slide joint in the housing |
| 40 | compresses air |
| 41 | pneumatic cylinder |
| 42 | rotation joint of the crank |
| 43 | motor |
| 44 | control unit for the clamps |
| 45 | piston of the pneumatic cylinder |
| 46 | piston rod |
| 47 | spring on the piston |
| 48 | opening for compressed air |

The invention claimed is:

1. Weaving machine with an apparatus (5) for holding and feeding weft threads (1, 2) to a gripper (6) of the weaving machine with a first and a second clamp (11, 12) for clamping the weft threads (1, 2), as well as with respectively one drive (25, 29) for each one of the two clamps, with which the two clamps (11, 12) are movable independently of one another along motion paths (35, 36) into respectively a feed position (16, 19), a transfer position (17, 20) and a ready position (18, 21), wherein these three positions are arranged on an insertion side of the weaving machine and wherein the respective feed positions (16, 19) of the clamps (11, 12) are arranged in an area between a running path of the gripper (6) and an extension of a beat-up line (10) of a weaving reed (9) of the weaving machine and wherein the respective transfer positions (17, 20) of the clamps (11, 12) are arranged in an area of the extension of the beat-up line (10) and wherein the respective ready positions (18, 21) of the clamps are arranged in an area above the respective feed position and the transfer position (16, 19; 17, 20), characterized in that the drives (25, 29) of the clamps are embodied and arranged on the weaving machine in such a manner so that the motion path (35, 36) of each clamp comprises a shape that is closed in itself, wherein each clamp (11, 12) is movable by means of the associated drive (25, 29) into the three positions arranged one after another along the respective motion path (35, 36), namely the feed position (16, 19), the transfer position (17, 20) and the ready position (18, 21), and that the respective clamp (11, 12) is movable from its ready position (18, 21) into its feed positions (16, 19) without thereby coming into its intermediately located transfer position (17, 20).

2. Weaving machine with an apparatus (5) according to claim 1, in which the drives (25, 29) of the clamps are configured in such a manner so that the motion paths (35, 36) of the clamps respectively extend in motion planes.

3. Weaving machine according to claim 1, in which the drive (25, 29) of each clamp is respectively arranged on an own housing or a carrier plate (24, 28).

4. Weaving machine according to claim 3, in which modules (33, 34) with a drive (25, 29), a housing (24, 28) and a clamp (11, 12) are arranged in such a manner on the weaving machine so that the motion planes of the clamps (35, 36) with respect to the warp direction of the weaving machine are bent by an angle that lies in a horizontal plane of the weaving machine.

5. Weaving machine according to claim 3, in which modules (33, 34) with a drive (25, 29), a housing (24, 28) and a clamp (11, 12) are arranged in such a manner on the weaving machine so that the motion planes of the clamps (35, 36) among one another are bent by an angle that lies in a vertical plane of the weaving machine extending in the weft direction.

6. Weaving machine according to claim 1, in which electronic adjusting means or programming means are present, with which the motion beginning of the clamps (11, 12) from its respective ready position (18, 21) into its respective feed position (16, 19) in the weaving cycle of the weaving machine is adjustable or programmable.

7. Module (33, 34) for holding and feeding a weft thread (1, 2) to the gripper (6) of a weaving machine with a housing or a carrier plate (24, 28), as well as with a clamp (11, 12) for the weft thread (1, 2), as well as with a drive (25, 29), with which the clamp (11, 12) is movable along a motion path (35, 36) into various different positions (16-18, 19-21), characterized in that the drive (25, 29) includes a jointed transmission or linkage mechanism, which is embodied in such a manner so that the motion path (35, 36) of the clamp comprises a shape that is closed in itself, so that by means of the drive the clamp (11, 12) is movable into three positions (16-18, 19-21) arranged one after another along the motion path (35, 36), and the clamp (11, 12) is movable from the last one of these three positions into the first one of these three positions without thereby coming into the intermediately located second position.

8. Module (33, 34) according to claim 7, in which the drive (25, 29) includes a motor (43) and in which the jointed transmission or linkage mechanism comprises a crank (38), which is drivable by the motor (43), furthermore with a push rod (23, 27), which is connected with the crank (38) and which is slidably supported in a slide joint (37), wherein the slide joint (37) is supported in a rotation point (39) with respect to the housing (24, 28) of the module (33, 34), furthermore with a clamp (11, 12) for the weft thread, wherein the clamp (11, 12) is mounted on the push rod (23, 27).

9. Module (33, 34) according to claim 8, in which the push rod (23, 27) includes a pneumatic cylinder (41) with a pneumatic piston (45) and with a piston rod (46), wherein the clamp (11, 12) is connected with the piston rod (46) in such a manner so that the clamp (11, 12) can be opened and closed by actuating the pneumatic cylinder (41).

10. Method for holding, feeding and inserting weft threads (1, 2) in a loom shed (7) of a weaving machine, wherein at least two weft threads (1, 2) and at least one gripper (6) for the insertion of the weft threads (1, 2) are present, as well as with at least one first and one second clamp (11, 12) as well as with at least one first and one second drive (25, 29), with which the clamps are moved independently of one another on different motion paths (35, 36) into different positions (16-18, 19-21), furthermore with means (15) for cutting the inserted weft thread (1, 2), wherein successive weaving cycles of the weaving machine include the following method steps:

moving the first clamp (11) with an end of first weft thread (1) clamped therein out of a ready position (18) of the first clamp into a feed position (16) of the first clamp;

grasping the first weft thread (1) by the gripper (6);

inserting the first weft thread (1) into the loom shed (7);

moving the first clamp (11) into a transfer position (17) of the first clamp;

beating-up the first weft thread (1) against a beat-up line (10) of the weaving machine by means of a beat-up motion of a weaving reed (9);

taking over the first weft thread (1) by the first clamp (11);

cutting the first weft thread (1) so that a new first weft thread end arises;

moving the first clamp (11) with the new end of the first weft thread (1) clamped therein out of the transfer position (17) of the first clamp into the ready position (18) of the first clamp;

moving the second clamp (12) with an end of a second weft thread (2) clamped therein out of a ready position (21) of the second clamp into a feed position (19) of the second clamp;

grasping the second weft thread (2) by the gripper (6);

inserting the second weft thread (2) into the loom shed (7);

moving the second clamp (12) into a transfer position (20) of the second clamp;

beating-up the second weft thread (2) against the beat-up line (10) of the weaving machine by means of a beating-up motion of the weaving reed (9);

taking over the second weft thread (2) by the second clamp (12);

cutting the second weft thread (2) so that a new second weft thread end arises;

moving the second clamp (12) with the new end of the second weft thread (2) clamped therein out of the transfer position (20) of the second clamp into the ready position (21) of the second clamp;

wherein the method is characterized in that the drives (25, 29) of the clamps are embodied and arranged on the weaving machine in such a manner so that the motion path (35, 36) of each clamp comprises a shape that is closed in itself, and that each clamp (11, 12) is moved by means of the associated drive (25, 29) into three positions arranged one after another along the respective motion path (35, 36), namely the feed position (16, 19), the transfer position (17, 20) and the ready position (18, 21), and that the respective clamp (11, 12) is moved from the ready position (18, 21) into the feed positions (16, 19) without thereby coming into the intermediately located transfer position (17, 20), wherein the motion beginning of the motion of at least one of the two clamps (11, 12) out of its ready position (18, 21) into its feed position (16, 19) in the weaving cycle of the weaving machine lies in a time segment that extends from the beginning of the beat-up motion of the weaving reed (9) until the beat-up of the previously inserted weft thread (1, 2) against the beat-up line (10) of the weaving machine.

* * * * *